United States Patent [19]

Sawada et al.

[11] 4,064,817

[45] Dec. 27, 1977

[54] PATTERN INDICATOR MECHANISM FOR A SEWING MACHINE

[75] Inventors: Toshio Sawada; Kimihiko Yamamoto; Hitoshi Ishikawa, all of Kariya, Japan

[73] Assignee: Aisin Seiki Kabushiki Kaisha, Kariya, Japan

[21] Appl. No.: 736,412

[22] Filed: Oct. 28, 1976

[30] Foreign Application Priority Data

Nov. 14, 1975 Japan ..... 50-155665[U]

[51] Int. Cl.[2] ..... D05B 3/02

[52] U.S. Cl. ..... 112/158 F

[58] Field of Search ..... 112/158 F, 158 R, 158 A, 112/210, 209

[56] References Cited

U.S. PATENT DOCUMENTS

| | | | |
|---|---|---|---|
| 3,034,461 | 5/1962 | Urscheler | 112/158 F |
| 3,070,050 | 12/1962 | Holl et al. | 112/158 F |
| 3,643,612 | 2/1972 | Hanyu et al. | 112/158 R |
| 3,696,768 | 10/1972 | Torii | 112/158 R |

*Primary Examiner*—H. Hampton Hunter

*Attorney, Agent, or Firm*—Burns, Doane, Swecker & Mathis

[57] ABSTRACT

A pattern indicator mechanism for a sewing machine includes a pattern selector knob rotatably mounted on the machine and which is operatively connected to a pattern selector cam mechanism, and a pattern indicator plate having a plurality of patterns illustrated thereon also operatively connected to the pattern selector cam mechanism for indicating a pattern selected by the pattern selector knob. Also included is a feed length indicator plate operatively connected to the pattern selector cam mechanism which automatically indicates a feed length corresponding to the pattern chosen by the selector knob.

6 Claims, 3 Drawing Figures

PATTERN INDICATOR MECHANISM FOR A SEWING MACHINE

BACKGROUND OF THE INVENTION

1. Field of the Invention

This invention relates to a sewing machine provided with a sewing pattern selector mechanism.

2. Prior Art

"Home Sewing" is now rather popular and in connection therewith a sewing machine is required which is easy to operate and yet provides for selection of a particular sewing pattern from one of may different stitch patterns provided in the sewing mechanism. However, such sewing machines are often so complex that reference to a user's manual, or the like is necessary in conjunction with pattern selection.

SUMMARY OF THE INVENTION

The object of the present invention is to provide a more simple and easier to operate pattern selector mechanism which is functionally associated with a stitch length indicator. The latter automatically indicates the proper length of stitch which corresponds to the pattern that has been selected. Simultaneously, the proper length of stitch is obtained by setting a feed control means to a mark indicated by the indicator.

This objective is attained by use of a pattern selector knob rotatably mounted on the machine and which is operatively connected to a stitch pattern selector cam mechanism provided on the machine. A pattern indicator plate having a plurality of pattern symbols illustrated thereon is also operatively connected to the pattern selector cam mechanism for indicating a particular sewing stitch pattern chosen by the pattern selector knob and a feed length indicator plate likewise operatively connected to the pattern selector cam mechanism automatically indicates a feed length which corresponds to the selected pattern, and which can then be set on the mechanism controlling the length of feed by a control knob correlated with the feed length indicator plate.

BRIEF DESCRIPTION OF THE DRAWINGS

The foregoing as well as other objects and advantages inherent in the invention will become more apparent from the following detailed description of a preferred embodiment thereof in conjunction with the attached drawings in which.

DETAILED DESCRIPTION OF THE PREFERRED EMBODIMENT

Figure 1:
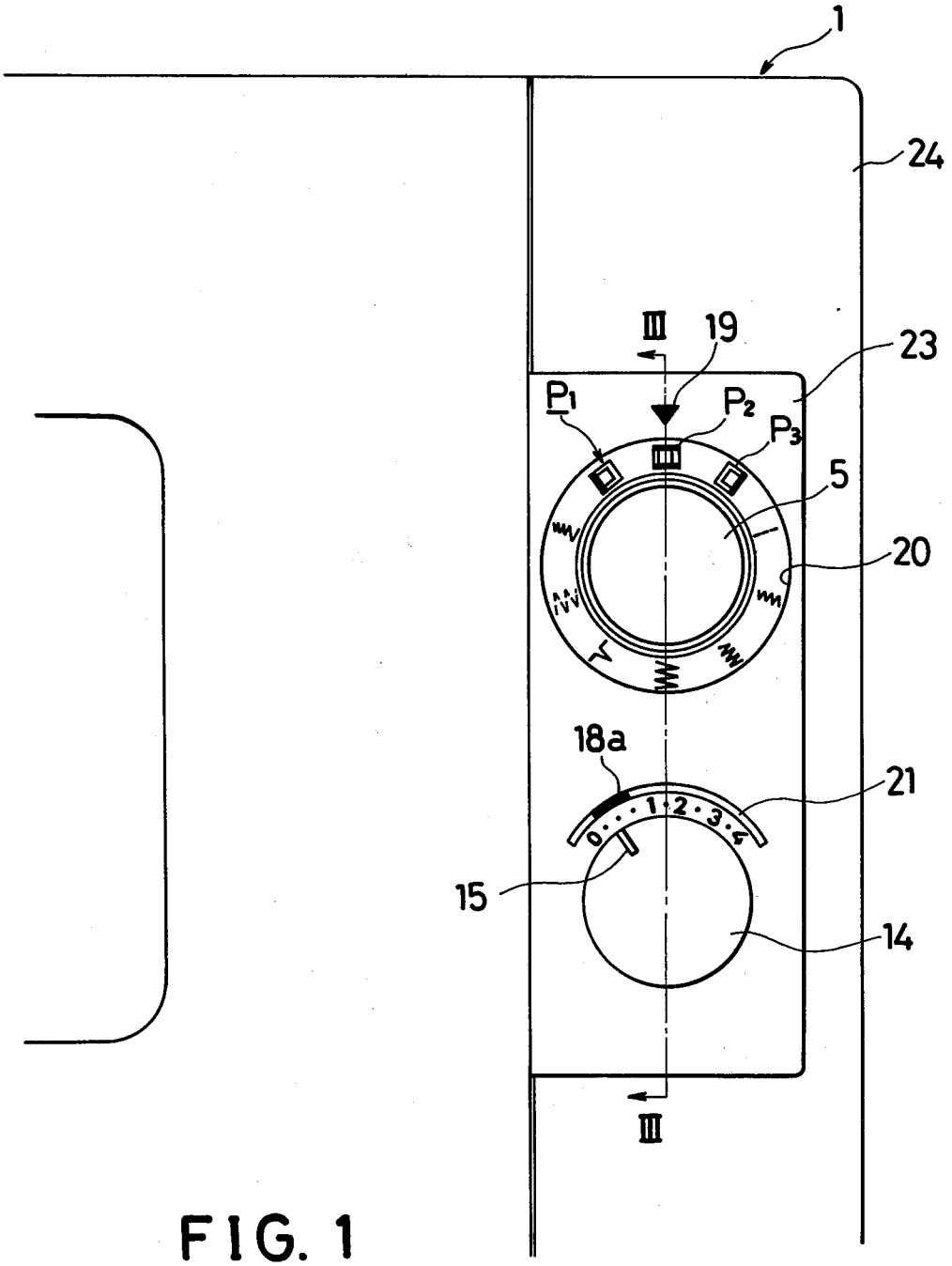
FIG. 1 is a front elevation of a part of a sewing machine frame showing the stitch pattern selector knob and pattern indicator plate actuated by it, and the feed length indicator plate located below the pattern selector knob and also actuated by the latter for automatically indicating a feed length corresponding to the selected stitch pattern, together with a control knob for setting the feed length control mechanism.

With reference now to the drawings, a part of a frame of a generally conventional sewing machine is indicated at 1. A bracket component 2 of the frame supports a shaft 3 and also a pattern selector cam mechanism to be later described in further detail. A gear wheel 4 is rotatably mounted on shaft 3 and a pattern selector knob 5 also mounted on shaft 3 is secured to gear wheel 4 for unitary rotation therewith. Axial movement of knob 5 is prevented by means of a stop in the form of a headed bolt 6 which threads into the end of shaft 3.

A pattern indicator gear wheel 7 is rotatably mounted on a smaller diameter hub portion 4a of gear wheel 4 and can be rotated independently of rotation of the latter. An annular pattern indicator plate 8 is secured to the left end face of gear wheel 7 as shown in FIG. 3 and various types of stitch patterns P are located in a circle about its annular surface.

A pattern selector cam actuating shaft 9 is rotatably mounted on the bracket component 2. A stepped gear wheel 12 is secured to shaft 9 at one end thereof and a pattern selector cam mechanism 30 is engaged with the other end of this shaft. The teeth 10 of the larger diameter portion of gear wheel 12 are meshed with the teeth of gear wheel 4, and the teeth 11 of the smaller diameter portion of gear wheel 12 are meshed with the teeth of the pattern indicator gear wheel 7.

A feed control shaft 13 is rotatably mounted on the bracket component 2 and a feed control knob 14 is secured to the end of this shaft in a position below knob 5. As shown in FIG. 1, an index mark 15 is provided on the face of knob 14 for indicating the proper feed position corresponding to a selected pattern.

Figure 3:
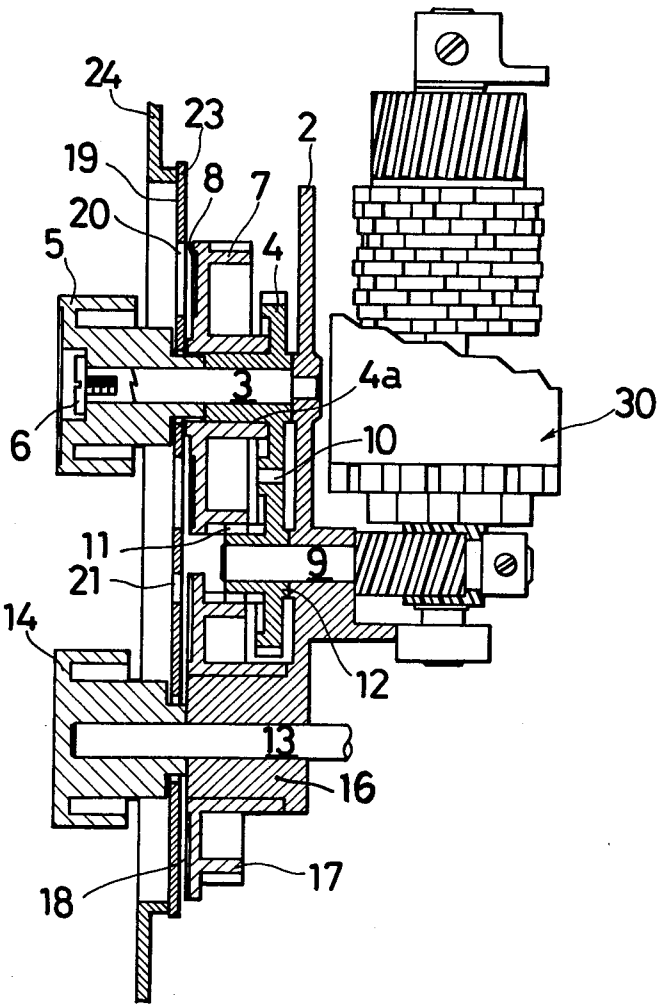
FIG. 3 is a vertical transverse section taken on line III—III of FIG. 1.

As shown in FIG. 3, the three shafts mentioned, namely, the pattern indicator shaft 3, the pattern selector shaft 9 and the feed control shaft 13 are located in parallel spaced relation to one another.

Figure 2:
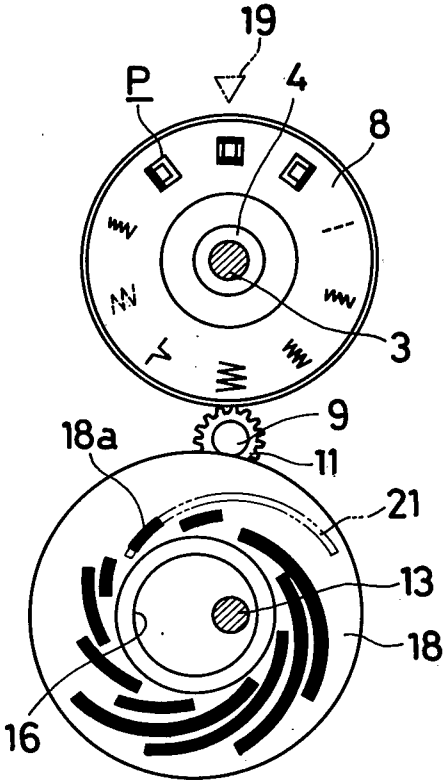
FIG. 2 is a front view of the pattern indicator plate and the feed indicator plate together with the inter-relation therebetween.

A feed indicator gear wheel 17 is rotatably mounted on a stud portion 16 projecting from the bracket component 2 which is eccentric to the feed control shaft 13 which passes through it. The teeth of gear wheel 17 are meshed with the teeth 11 on the smaller diameter part of the stepped gear wheel 12. A feed indicator plate 18 as shown in FIG. 2 is secured to one end of gear wheel 17 and includes on its face several feed zone indicia 18a which have a spiral-shaped configuration.

Located in front of the aligned indicator plates 8 and 18 is a panel 23 which is secured to another bracket component 24. Panel 23 includes an index mark 19 just above the location of indicator plate 8 and also an arcuately arranged series of numbers 0-1-2-3-4 located between the periphery of control knob 14 and an arcuate transparent slot 21 through which are viewed the spiral-shaped feed zone marks 18a included on plate 18.

Also included on panel 23 is a transparent annular portion 20 coextensive with annular indicator plate 8 for showing the patterns P spaced around it.

The pattern indicator mechanism operates in the following manner. If the user of the machine desires to select a particular one of the ten different stitching patterns illustrated on the face of pattern indicator plate 8, e.g., a button hole pattern, the pattern selector knob 5 is rotated until this particular pattern ($P_1$) on the indicator plate is aligned with the index mark 19. As illustrated, knob 5 is presently set for stitch pattern $P_2$. As knob 5 is rotated so also is gear wheel 4 which thereby results in rotation of cam actuating shaft 9 since its teeth are meshed with the teeth 10 on the larger diameter portion of gear wheel 12. Rotation of shaft 9 results in operation of the cam mechanism 30 which selects the chosen stitching pattern operation. Rotation of gear wheel 4 will also rotate gear wheel 7 since the teeth of the latter are meshed with the teeth 11 on the smaller diameter portion of gear wheel 12. This rotation of gear wheel 7 thus brings the pattern $P_1$ on plate 8 into alignment with index mark 19.

Simultaneously, due to rotation of the smaller diameter toothed portion 11 of gear wheel 12, the gear wheel 17 which is meshed with it will also be rotated together with the feed indicator plate 18 secured to it thereby to indicate the proper feed length in relation to the selected pattern $P_1$. The feed length is viewed in the window portion 21 of plate 23. The user will then only need to turn the feed length control knob 14 to set the index mark 15 thereon to the proper feed length as indicated on the indicator plate 18. Rotation of knob 14 is transmitted to the feed length control mechanism (not illustrated since it is conventional) by rotation of shaft 13 to which knob 14 is secured thereby to actuate the needle bar. The numerals 0-1-2-3-4 on plate 23 indicate the feed length.

We claim:

1. A stitch pattern indicator mechanism for a sewing machine having a pattern selector cam mechanism comprising:

a pattern selector knob rotatably mounted on said machine;

a cam actuating means operatively connected to said pattern selector knob for actuating said pattern selector cam mechanism upon rotation of said pattern selector knob;

a pattern indicator plate having a plurality of pattern symbols illustrated thereon and which is operatively connected to said cam actuating means for indicating a pattern selected by said pattern selector knob; and a feed length indicator plate operatively connected to said cam actuating means for automatically indicating a feed length corresponding to the pattern selected by said pattern selector knob.

2. A stitch pattern indicator mechanism as defined in claim 1 and which further comprises a feed control knob rotatably mounted on said machine and which is operatively connected to a feed control mechanism of the machine whereby upon setting said feed control knob to the feed length indicated by said feed length indicator plate the feed control mechanism is operated to set the machine for the selected stitch pattern.

3. A stitch pattern indicator mechanism as defined in claim 2 wherein said pattern and feed length indicators are visible from the outside of the machine and are positioned around said selector knob and feed control knob respectively.

4. A stitch pattern indicator mechanism as defined in claim 2 wherein said cam actuating means includes a first gear wheel rotatable with said pattern selector knob and a second gear wheel meshed with said first gear wheel for rotating a cam actuating shaft of said pattern selector cam mechanism.

5. A stitch pattern indicator mechanism as defined in claim 4 wherein said cam actuating means further includes a third gear wheel meshed with a small diameter toothed portion of said second gear wheel, said third gear wheel attaching thereon said pattern indicator plate whereby upon rotation of said pattern selector knob said third gear wheel is rotated to change the positions of the pattern marks illustrated on said pattern indicator plate.

6. A stitch pattern indicator mechanism as defined in claim 5 wherein said cam actuating means further includes a fourth gear wheel meshed with said small diameter toothed portion of said second gear wheel, said fourth gear wheel attaching thereon said feed length indicator plate whereby upon rotation of said pattern selector knob said fourth gear wheel is rotated to indicate feed length in response to the pattern selected.

* * * * *